US008403242B2

(12) United States Patent
Bucceri

(10) Patent No.: US 8,403,242 B2
(45) Date of Patent: Mar. 26, 2013

(54) SNOW MAKING METHOD AND APPARATUS

(76) Inventor: Alfio Bucceri, Hamilton (AU)

( * ) Notice: Subject to any disclaimer, the term of this patent is extended or adjusted under 35 U.S.C. 154(b) by 204 days.

(21) Appl. No.: 12/928,622

(22) Filed: Dec. 15, 2010

(65) Prior Publication Data

US 2011/0147498 A1 Jun. 23, 2011

(30) Foreign Application Priority Data

Dec. 15, 2009 (AU) ..... 2009906097

(51) Int. Cl.
*B02C 25/00* (2006.01)

(52) U.S. Cl. ..... 241/30; 241/DIG. 17

(58) Field of Classification Search ..... 241/30, 241/DIG. 17
See application file for complete search history.

(56) References Cited

U.S. PATENT DOCUMENTS 4,718,610 A * 1/1988 Gallaher ..... 241/37.5
4,742,958 A 5/1988 Bucceri
4,793,142 A 12/1988 Bucceri
5,242,125 A * 9/1993 Rupp ..... 241/93
5,297,731 A 3/1994 Bucceri
5,687,919 A * 11/1997 Cory ..... 241/60
6,334,327 B1 * 1/2002 Fujiwara ..... 62/320
6,454,182 B1 9/2002 Bucceri
6,527,212 B2 * 3/2003 Rupp ..... 241/293
6,575,381 B1 * 6/2003 Fujiwara ..... 239/2.2
6,908,053 B2 * 6/2005 Rupp ..... 241/86.1
6,938,830 B2 9/2005 Bucceri
6,951,308 B2 10/2005 Bucceri
7,484,373 B2 2/2009 Bucceri

* cited by examiner

*Primary Examiner* — Faye Francis
(74) *Attorney, Agent, or Firm* — Hudak, Shunk & Farine Co. LPA

(57) ABSTRACT

A system for producing snow incorporates a snow-making machine with ice supplied externally or manufactured on-site. The snow-making machine has one or more multi-bladed impellers fitted blades which impact ice blocks, pieces or tubes fed to the inlet of a snow-making chamber. The impact of the blades with the ice in a velocity range 150-300 Km/h produces artificial snow, with characteristics very similar to natural snow, suitable for ski-fields or other applications for snow. The blades may incorporate serrated or jagged cutter portions the break the latter ice pieces to sizes suitable for conversion to snow.

7 Claims, 10 Drawing Sheets

SNOW MAKING METHOD AND APPARATUS

BACKGROUND OF THE INVENTION

1. Field of the Invention

The present invention relates to a method of making snow.

The present invention particularly relates, but is not limited to, a method of manufacturing snow from ice, which may be provided in block or tube form.

The invention also relates to the apparatus for making the snow; and to a system for producing the ice and converting the ice to snow for use on ski-slopes.

Throughout the specification, the term "snow" shall include artificial snow, or man-made snow, having characteristics similar to, if not identical to, natural snow.

2. Prior Art

There have been many proposals for the manufacture of artificial snow for use on ski-slopes or in entertainment precincts; and examples of the inventor's own earlier proposals can be found in U.S. Pat. Nos. 7,484,373; 6,951,308; 6,938,830; 6,454,182; 5,297,731; 4,793,142 and 4,742,958 (Bucceri, Alfio), reflecting the inventor's nearly 15 years of research in this area of technology.

While the proposals have enjoyed some commercial success, practical problems which have arisen include:

a) the costs of chemicals;

b) the capital cost of the equipment; and c) the ongoing running costs, particularly due to the energy inputs required.

SUMMARY OF THE PRESENT INVENTION

It is an object of the present invention to provide a method of making snow which eliminates, or at least ameliorates, the problems of the prior art methods.

It is a preferred object of the present invention to provide a method which produces a high-quality snow from ice, which may be provided in block or tube form.

It is a further preferred object to provide a method where the manufacture of the ice, and the conversion to snow, may be integrated e.g. to produce the snow on a ski-field for direct distribution there-over It is a still further preferred object to provide an apparatus for making the snow which may be relatively simple in construction, and which is relatively inexpensive to manufacture, but which is rugged, reliable and requires a relatively low energy input.

Other preferred objects will become apparent from the following description.

In one aspect, the present invention resides in a method for manufacturing snow, including:

driving at least one impeller, having at least one blade, rotatably mounted within a snow-making chamber of a snow-making apparatus;

feeding ice from a supply to at least one inlet of the snow-making chamber;

impacting the ice with the at least one blade to convert the ice to snow; and discharging the snow from at least one outlet from the snow-making chamber.

Preferably, the ice is fed to the at least one inlet in block or tube form.

Preferably, the, or each, blade of the impeller impacts the ice with a (preferably tangential) velocity component in the range 150-300 Km/h (93-187 MPH); more preferably 180-260 Km/h (112-161 MPH); most preferably 200-220 Km/h (124-137 MPH).

Preferably, the, or each, impeller is driven at 100%≦5% of a preselected rotational speed.

Preferably, air is introduced in the at least one inlet with the ice; and airflow within the snow-making chamber generated by the, or each, blade, assists the discharge of the snow from the at least one outlet.

Preferably, the snow-making chamber is separated into a plurality of sub-chambers by respective dividing walls between each pair of sub-chambers, each sub-chamber having a respective inlet and outlet, and each sub-chamber having a respective impeller with a plurality of the blades.

In a second aspect, the present invention resides in a snow-making apparatus, including:

a snow-making chamber having at least one inlet to receive ice from a supply and at least one outlet for the discharge of snow;

at least one impeller, having at least one blade, to impact the ice, rotatably mounted in the snow-making chamber; and a driving mechanism operably connected to the impeller to drive the, or each, blade to impact the ice and convert the ice into snow and discharge the snow from the at least one outlet.

Preferably, the, or each, impeller has at least two, more preferably three or four, blades extending substantially radially from an impeller shaft rotatably journalled in end walls of the snow-making chamber, where the impeller shaft is preferably rotated about a vertical, or horizontal, axis.

Preferably, the drive mechanism includes a motor (e.g. electric, hydraulic, pneumatic or internal combustion) connected to the impeller shaft by a transmission.

Preferably, the drive mechanism drives the impeller shaft at 100%≦5% of a preset rotational speed; where the rotational speed of the impeller shaft is selected so that the (preferably tangential) velocity component of the blade(s) impacting with the ice is the range 150-300 Km/h (93-187 MPH); more preferably 180-260 Km/h (112-161 MPH); most preferably 200-220 Km/h (124-137 MPH).

Preferably, the snow-making chamber is divided into a plurality of sub-chambers, each pair of sub-chambers being separated by a respective dividing wall, each sub-chamber having an inlet for the ice, an outlet for the discharge of the snow and an impeller.

Preferably, the ice is supplied to the, or each, inlet from a source of block ice or ice tubes.

Preferably, the blades of the impellers generate airflows in the snow-making chamber, or sub-chambers, to assist in the discharge of the snow from the, or each, outlet.

Preferably, each blade is mounted on a respective arm of an impeller, the blade having an elongate blade body with opposed, preferably planar, side faces, which impact the ice. Preferably, the blade body is convergent in side view from a proximal end to a distal end, the distal end of the blade body preferably having a hook-like formation.

Preferably, a serrated cutter portion is provided intermediate the blade body; the cutter portion preferably formed from a hardened steel- or titanium plate, which may have an outer portion, with a curved face, extending to the distal end of the body.

Preferably, the inlet and outlet for the snow-making chamber, or for each sub-chamber, is separated by at least 180°; more preferably up to 270°; in the direction of rotation of the impeller(s).

In a third aspect, the present invention resides a system for producing snow, including:

a supply of ice in block or tube form;

a snow-making apparatus as hereinbefore described;

an ice-transfer apparatus to transfer the ice to the, or each, inlet of the snow-making apparatus; and a snow-transfer apparatus to transfer the snow from the, or each, outlet of the snow-making apparatus.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
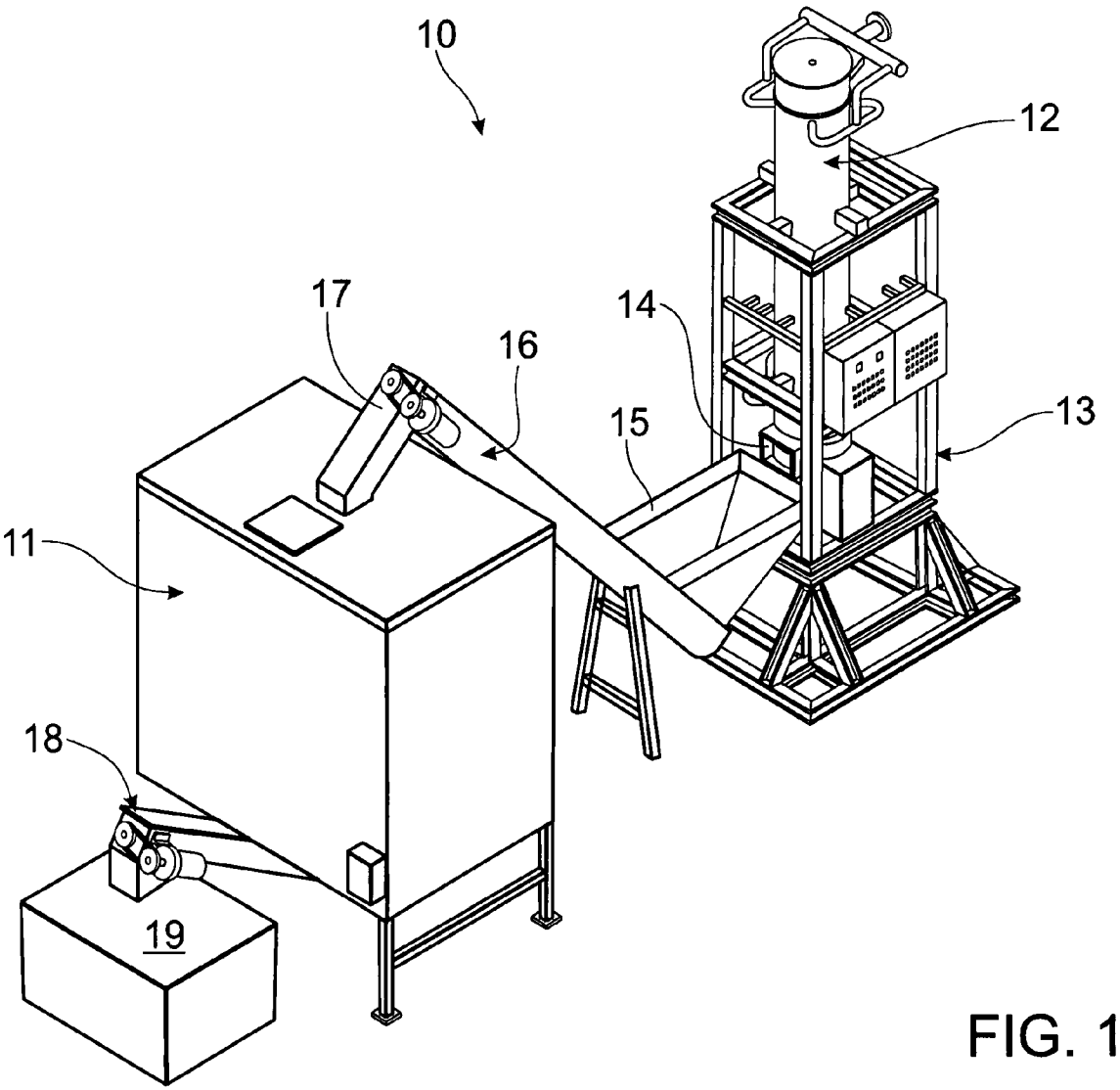
FIG. 1 is an isometric view of a first embodiment of a system for producing snow incorporating a snow-making machine in accordance with the present invention.

FIG. 1 illustrates a first embodiment of a system 10 for producing snow incorporating a snow-making machine 11 in accordance with the present invention, where ice tubes of, e.g., 100 mm (4 inch) diameter, are formed in a vertical tube-type ice maker 12 mounted in a support frame 13. The ice tubes are discharged from the ice maker 12 through a discharge outlet 14 to the hopper 15 of an ice-transfer elevator 16 which has a discharge chute 17 connected to the inlet of the snow-making machine 11 (to be hereinafter described).

The snow produced in the snow-making machine 11 is transferred by a snow-transfer auger or conveyor 18 to a storage container 19 which is preferably provided with refrigeration to maintain the snow below freezing temperature.

Figure 2A:
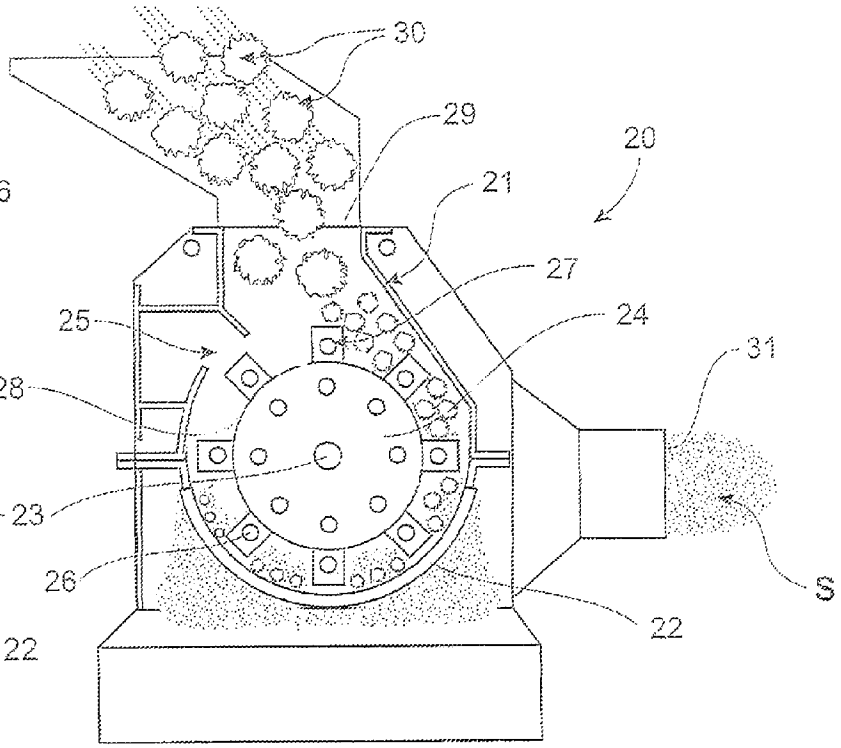
FIG. 2A is a schematic sectional end elevational view of the snow-making chamber of the snow-making apparatus.
Figure 2B:
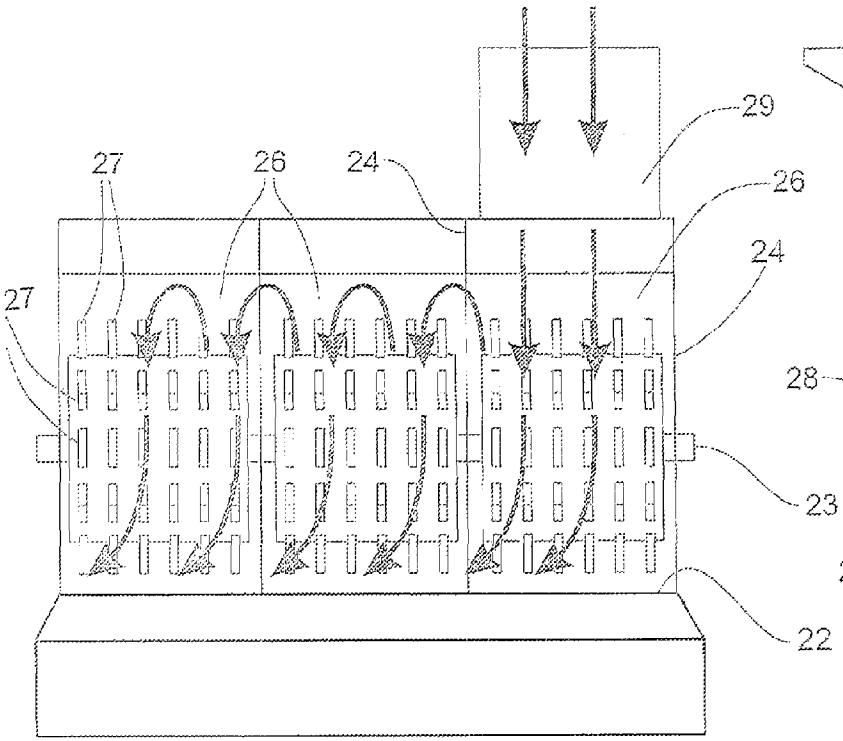
FIG. 2B is front-elevation view of FIG. 2A.

Referring to FIG. 2, the snow making machine 20 has a housing 21 with a curved lower wall 22. An impeller shaft 23 is rotatably journalled in end walls of the housing 21.

A plurality of dividing walls 24 are mounted on, and rotate with, the impeller shaft 23 to divide the snow-making chamber 25 within the housing 21 into a number of sub-chambers 26, a respective dividing wall 24 being provided between each pair of sub-chambers.

The impeller shaft 23 is connected to an electric motor via a suitable transmission system, e.g., a tooth belt-and-pulley (not shown).

A respective impeller 27 is provided in each sub-chamber 26 and has four equally spaced radially extending arms provided with blades 28 of the type to be hereinafter described with reference to FIG. 10.

The impellers 27 may be of the configuration to be hereinafter described with reference to FIG. 9.

An inlet 29 to the housing 21 is operably connected to each of the sub-chambers 26 and receives cut- or partially shattered sections of the ice tubes 30 which may optionally pass through a tube cutting mechanism to be described with reference to the embodiment of FIG. 3.

An outlet 31 from the housing 21 is also connected to the sub-chambers 26 to enable the discharge of the snow S from the snow-making machine 20.

The drive system rotates the impeller shaft 29 at a substantially constant rotational speed, (e.g., 100%≦5%), where the rotational speed is selected so, at the zone of contact impact between the impeller blades 28 and the sections of ice tubes 30, the (tangential) velocity of the blades 28 is in the range 150-300 Km/h (112-225 MPH); more preferably 180-260 Km/h (135-195 MPH), most preferably 200-220 Km/h (150-165 MPH).

When the velocity component of the blades 28 is within the specified ranges, artificial snow S, having characteristics very similar to natural snow, is produced. At velocities below the described ranges, the ice tends to be smashed into small pieces, but not snow crystals; while at velocity components above the desired ranges, the ice is converted into a wet "mush".

The tip areas of the blades 28 create air flows within the sub-chambers 26 which assist in the formation of the snow S and which also assist in transferring the snow S to the outlet 31.

Referring to the embodiment of FIGS. 3 to 5, the snow making machine 40 has an impeller shaft 41 rotating about a horizontal axis and driven in the same manner, as hereinbefore described with reference to FIG. 2. In this embodiment, blocks of ice 42 are fed to a supply hopper 43, and the blocks 42 pass along a gravity conveying passage 44 where sets of cutters 45, having hydraulically- or pneumatically-operated knives 46, break the blocks 42 up into smaller pieces 47, e.g., preferably having a maximum dimension no greater than 100-150 mm (4-6 inches).

Figure 4:
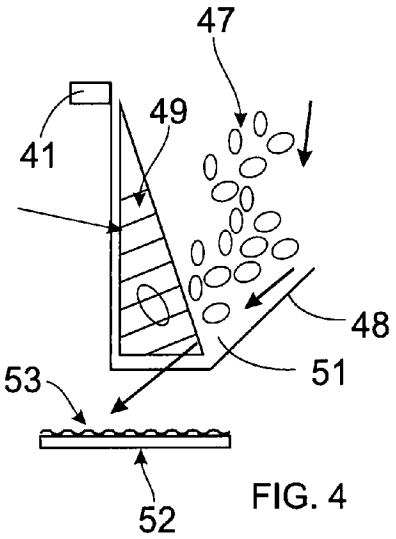
FIG. 4 is a schematic side view showing the feeding of the ice to the snow-making chamber of the snow-making machine in FIG. 3.

In this embodiment, and as illustrated in FIG. 4, the pieces 47 of ice slide down an inclined inlet plate 48 and enter the inlet 51 to the sub-chambers 50, where inlet 51 directs the ice pieces 47 towards the outer portion, e.g., 50-100% of the radial length, of the blades 49.

The side faces of the blades 49 impact the pieces 47 of ice and the snow S formed within the sub-chambers 50 is discharged via the outlet 52.

As will be described in more detail with reference to FIG. 10, a portion of the top face 53 of the blades 49 has a jagged or serrated profile as shown.

Figure 5:
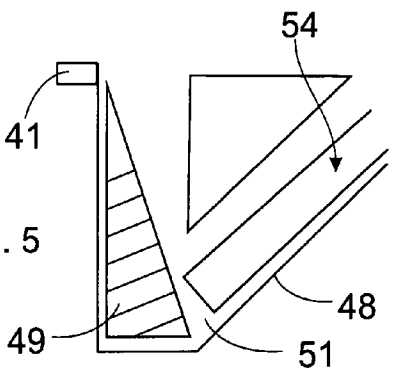
FIG. 5 is a similar view to FIG. 5 showing an air-line introducing air into the snow-making chamber.

FIG. 5 illustrates an alternative arrangement where an air line 54 within the inlet 51 directs pressurised air to the inlet 51, the air, combined with the air flow generated by the blades 49 assisting in the discharge of the snow S from the snow-making machine 40.

Figure 6:
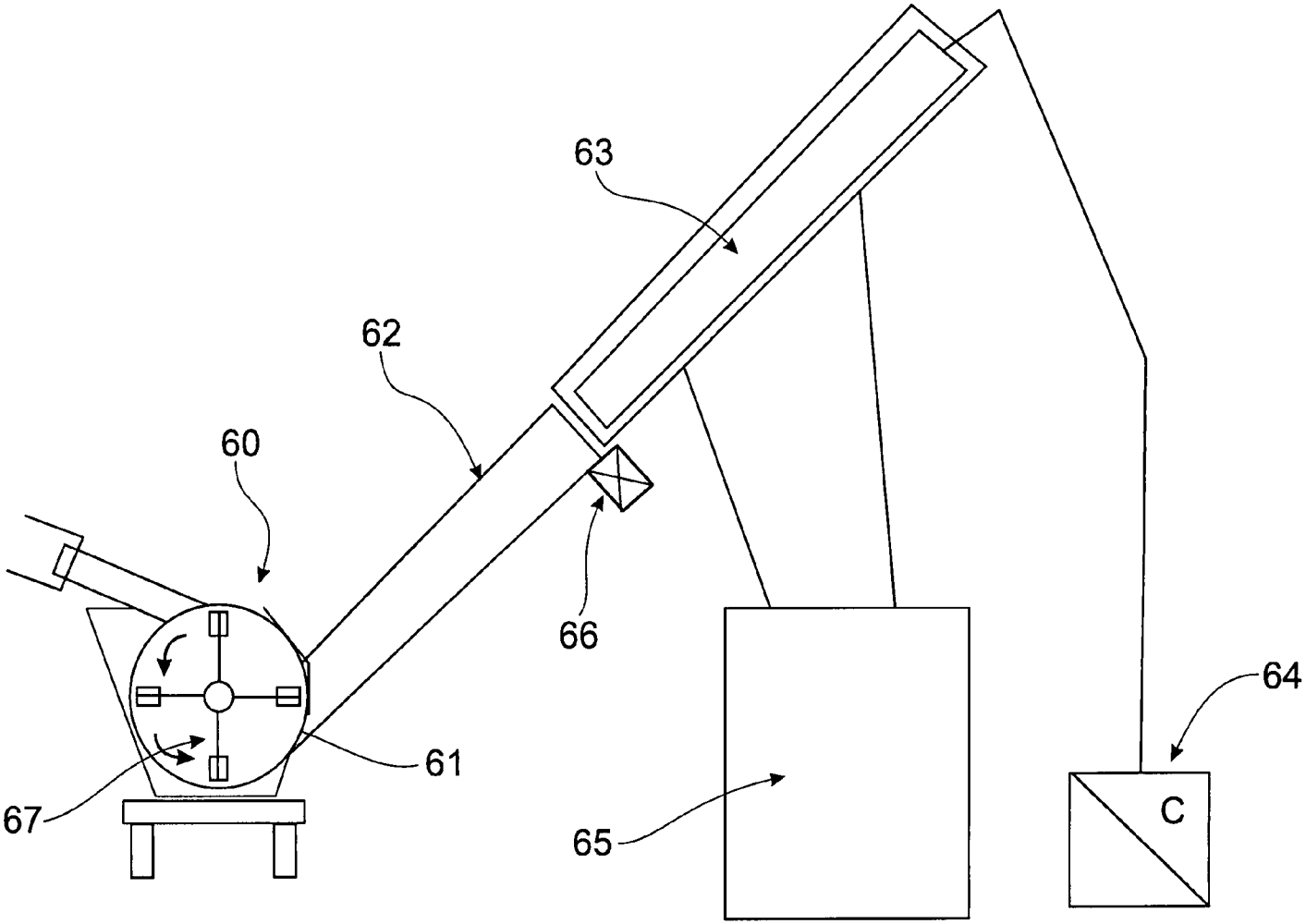
FIG. 6 is a schematic sectional end view of a third embodiment of a system for producing snow.

In the embodiment illustrated in FIG. 6, the inlet 61 of the snow-making machine 60 has a gravity ice conveying tube 62 which receives ice tubes from an ice tube maker 63, which receives water from a supply 64 and is chilled by a refrigeration unit 65.

The flow of the ice tubes is controlled by a gate valve 66 which prevents the flow of ice to the snow-making machine 60 from "overloading" the impellers 67.

Figure 3:
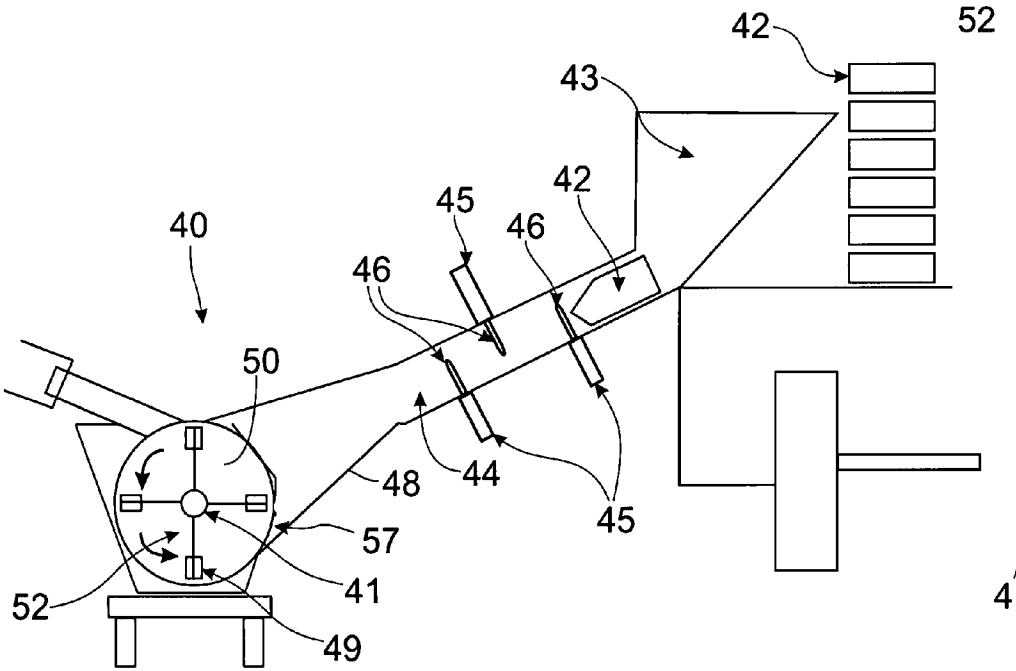
FIG. 3 is a schematic sectional end view of a second embodiment of a system for producing snow.

In the embodiments illustrated in FIGS. 2, 3 and 6, the impellers have been mounted on impeller shafts rotatably journalled for rotation about a horizontal axis.

Figure 7:
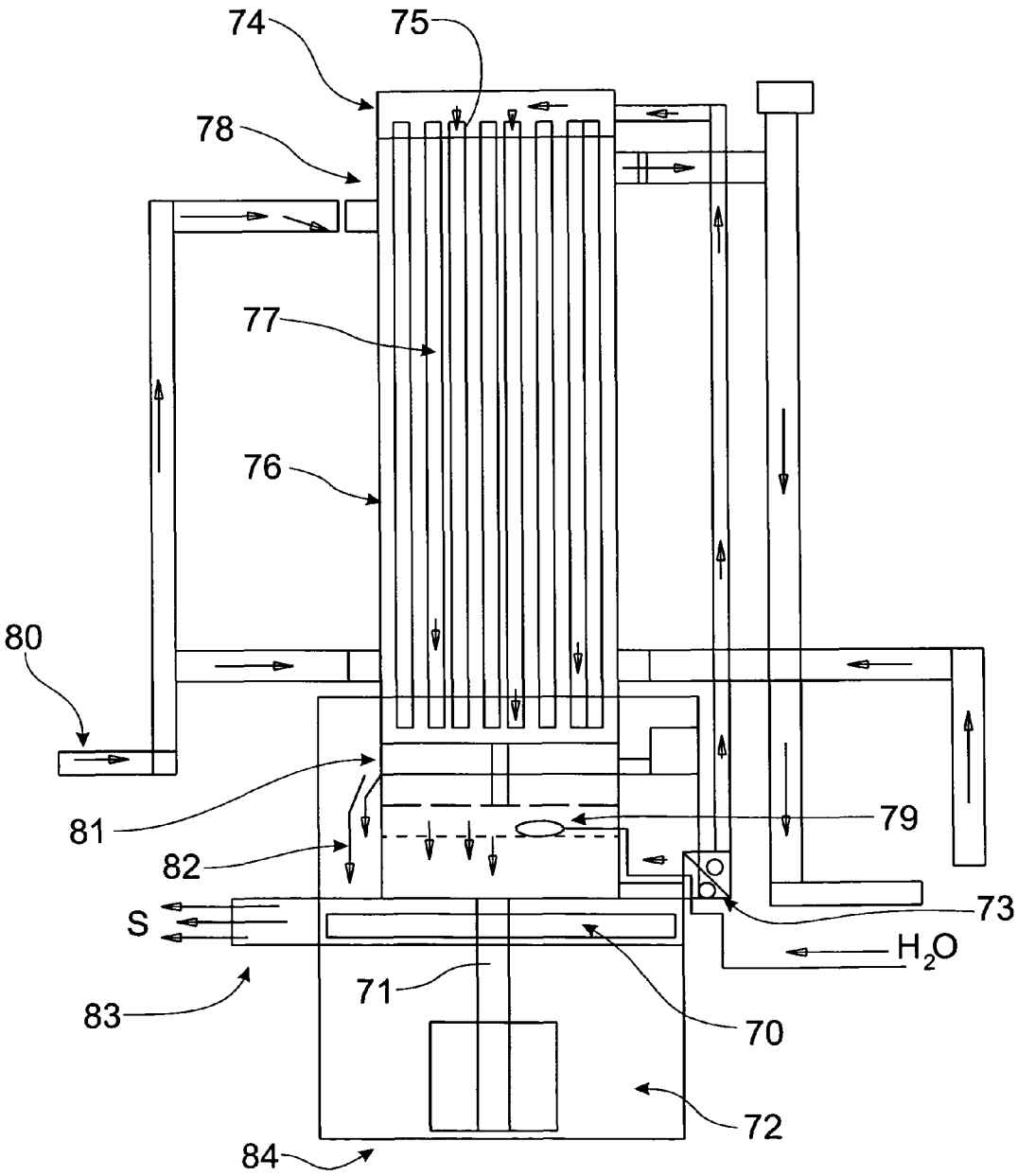
FIG. 7 is a schematic sectional side view of a fourth embodiment of a system for producing snow.

In the embodiment of FIG. 7, the impeller 70 is fitted to an impeller shaft 71 rotating about a vertical axis, the impeller shaft 71 being driven by an electric motor/transmission combination 72 which may also incorporate a snow blower. In this embodiment, water is pumped from a source via a water pump 73 to a water supply top tank 74 at the top of a plurality of 100 mm (4 inch) diameter water freezing tubes 75. The water freezing tubes 75 are contained within a cooling jacket 76 which contains a plurality of heat transfer freezer tubes 77 through which a refrigerant 80 such as brine at −12° is pumped.

The flow of water to the ice making machine 78 is controlled by a float valve 79 which shuts off the water pump 73 when the water supply top tank 74 has been refilled after filling the water freezing tubes 75.

Refrigerant 80, e.g., brine, at −12° C. is pumped into the cooling jacket 76 and through the heat transport freezer tubes 77 until all the water in the water freezing tubes 75 has been converted to ice.

The refrigerant 80 is drained from the cooling jacket 76, and hot gas or steam, e.g., obtained from a heat exchanger of the refrigeration apparatus, is pumped through the cooling jacket 76, e.g., for 30 seconds-2 minutes, to cause the outer layer of the ice tubes to melt and thereby pass down the water freezing tubes 75 to be cut into pieces 82 by an ice cutter 81, the ice pieces 82 then falling onto the blades of the impeller 70 and, after conversion to snow S, being discharged from the outlet 83 of the snow-making machine 84.

Figure 8:
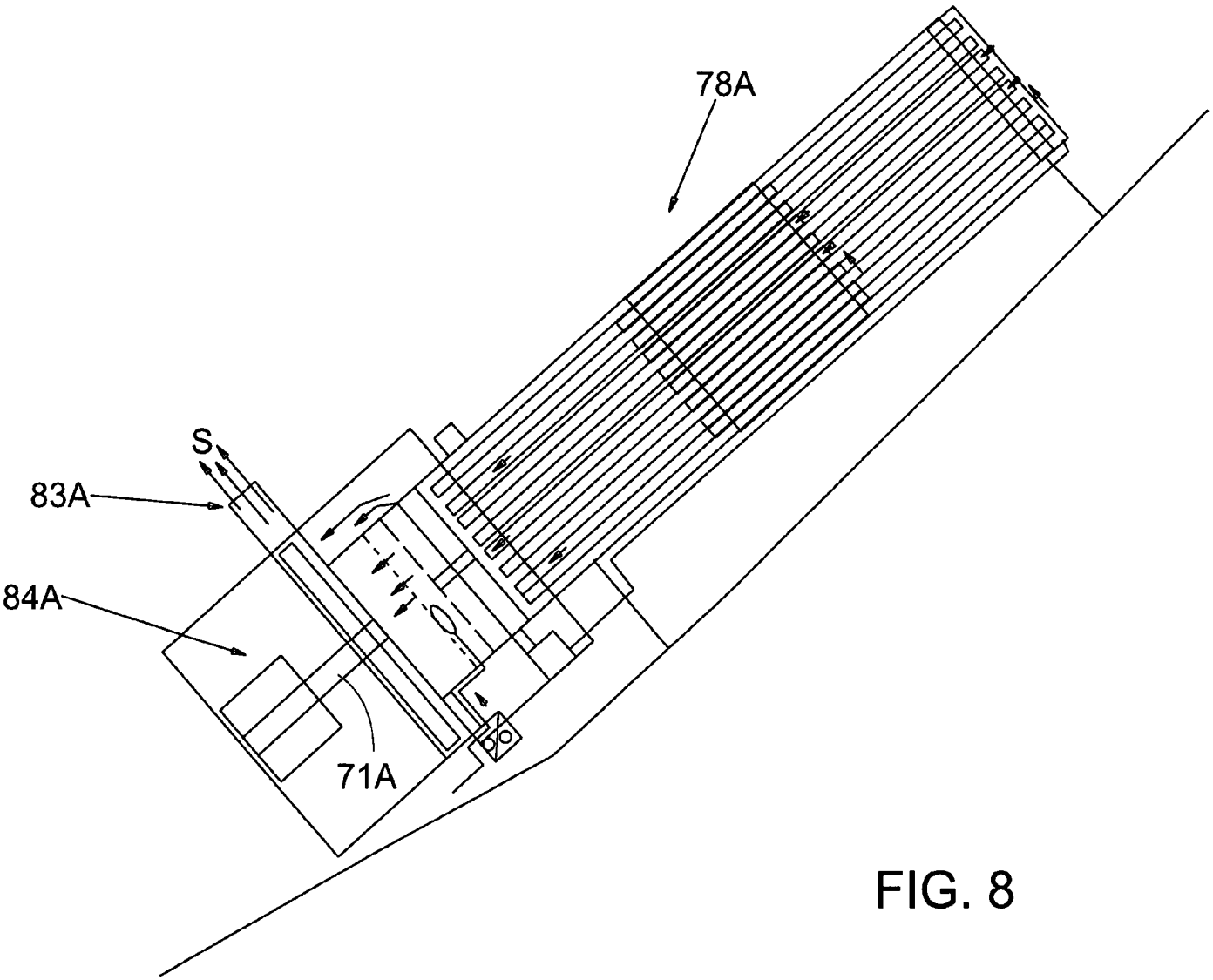
FIG. 8 is a schematic sectional side view of a fifth embodiment of a system for producing snow.

The embodiment in FIG. 8 is modified from the embodiment of FIG. 7 in that the machinery of the system is located at an inclination, e.g., on a hillside, to supply snow to a ski field.

In this embodiment, it will be noted that the impeller shaft 71A is inclined at an angle to the horizontal; and it is preferred that the outlet 83A from the snow-making machine A 8be provided at or adjacent the top of the machine 84A, so that the snow may be discharged onto a pile or dump approximately 20-50 meters (60-150 feet) from the machine. The snow S in the pile or dump may then be transported to desired locations on the ski field.

Alternatively, the outlet 83A may be connected to a transfer conveyor, e.g., a pneumatic conveyor, to enable the snow S to be transported to the desired location.

Figure 9:
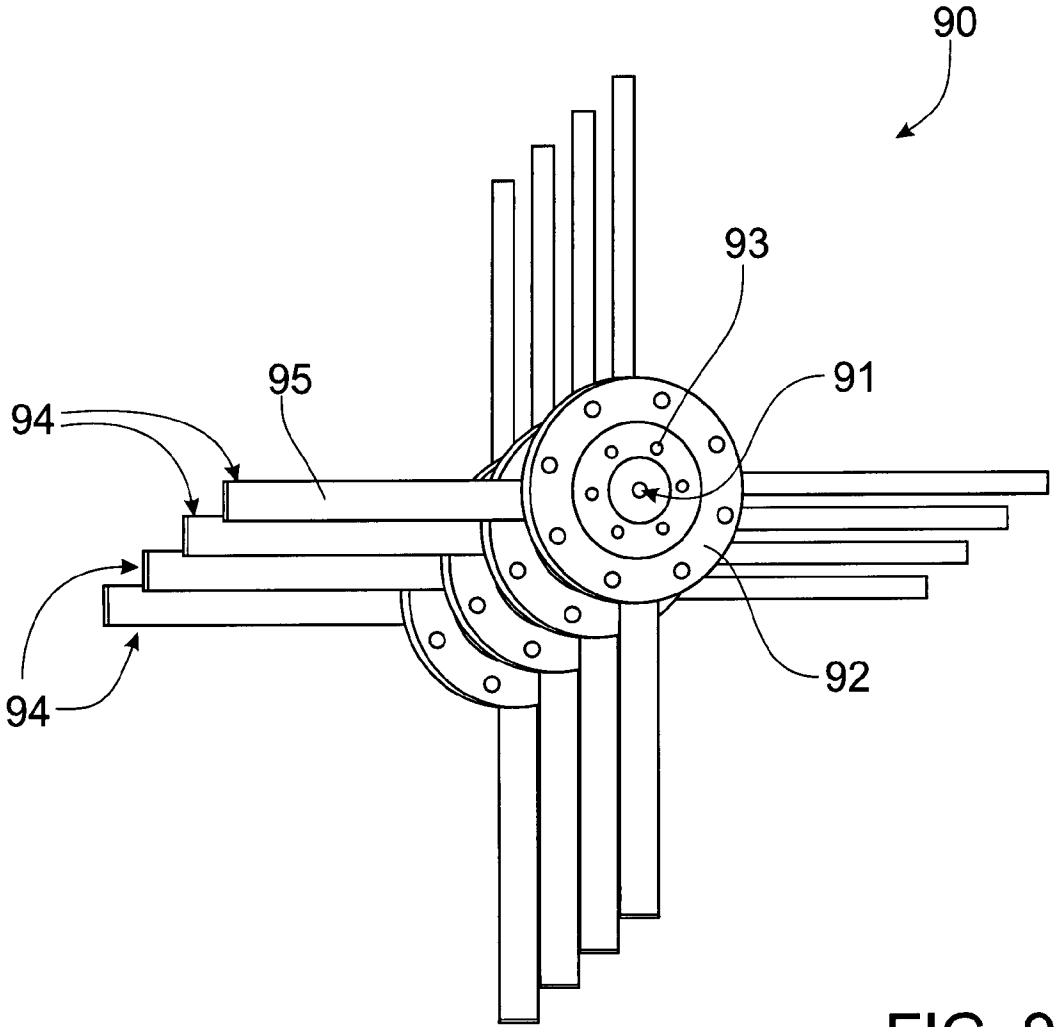
FIG. 9 is a isometric view of a plurality of the impellers mounted on a single drive shaft.

FIG. 9 illustrates a plurality (e.g., four) of the impellers 90 mounted on a common impeller shaft 91. Each impeller 90 has a hub 92 secured to the impeller shaft 91 by locking studs 93. Each impeller 90 has four equally-spaced radially extending arms 94, bolted or otherwise fixed to a respective hub 92, each arm 94 providing a mounting surface 95 for a respective blade to be hereinafter described with reference to FIG. 10.

Figure 10:
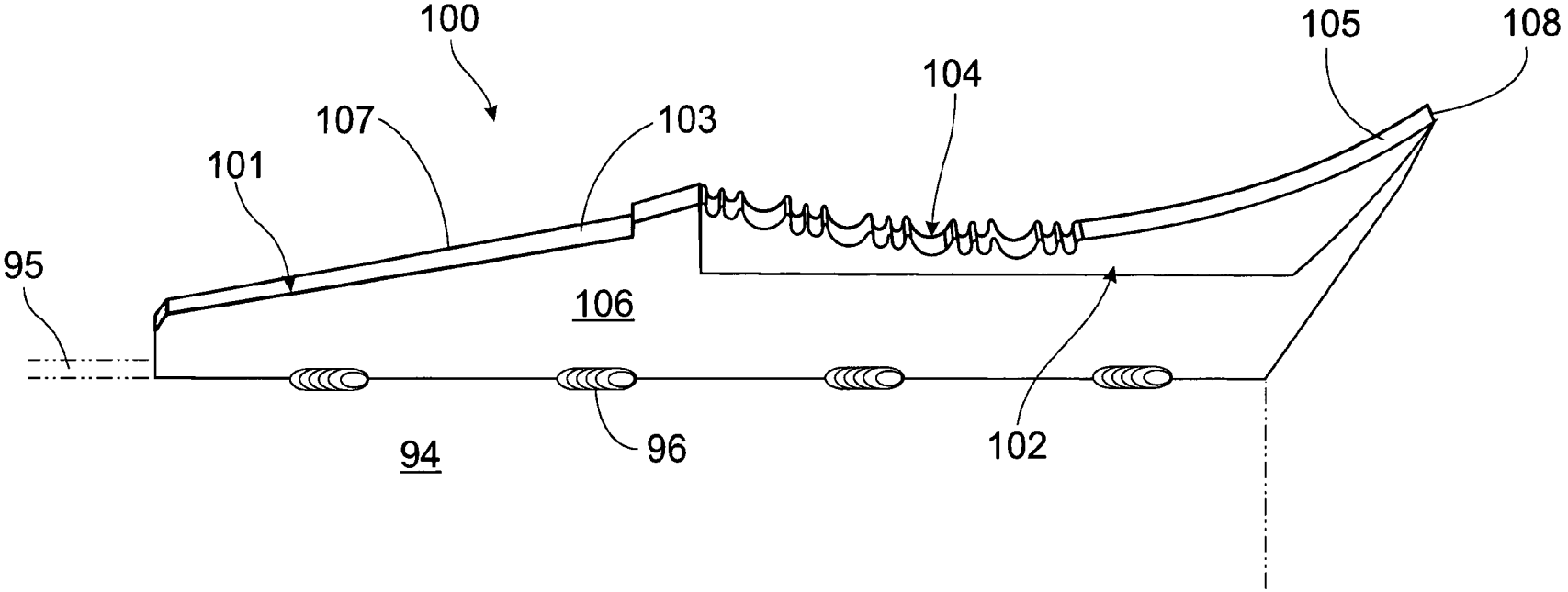
FIG. 10 is an isometric view of a blade for the impellers.

Referring to FIG. 10, each blade 100 has a substantially planar body 101 which is convergent from a proximal end to the distal end. A bottom wall rests on, or is received in, a groove in, the mounting face 95 of an impeller arm 94 and it is secured thereto by welding 96.

A hardened steel- or titanium plate 102 is provided along, e.g., the outer 50% of the top face 103 of the blade body 101, and has a serrated cutter portion 104 intermediate the length of the blade body 101, which leads to an upwardly curved hook-like formation 105 at the distal end of the blade body 101.

In operation, the pieces of ice are primarily impacted by the side faces 106. 107 of the blade body 101. However, any large pieces may engage, and be shattered by, the serrated cutter portion 104.

The increased height tip portion 108 at the distal end of the blade body 101 assists in generating an air flow through the snow making chamber, or sub-chambers, the tip portion 108 acting like a partial-paddle or fan-blade.

Figure 11:
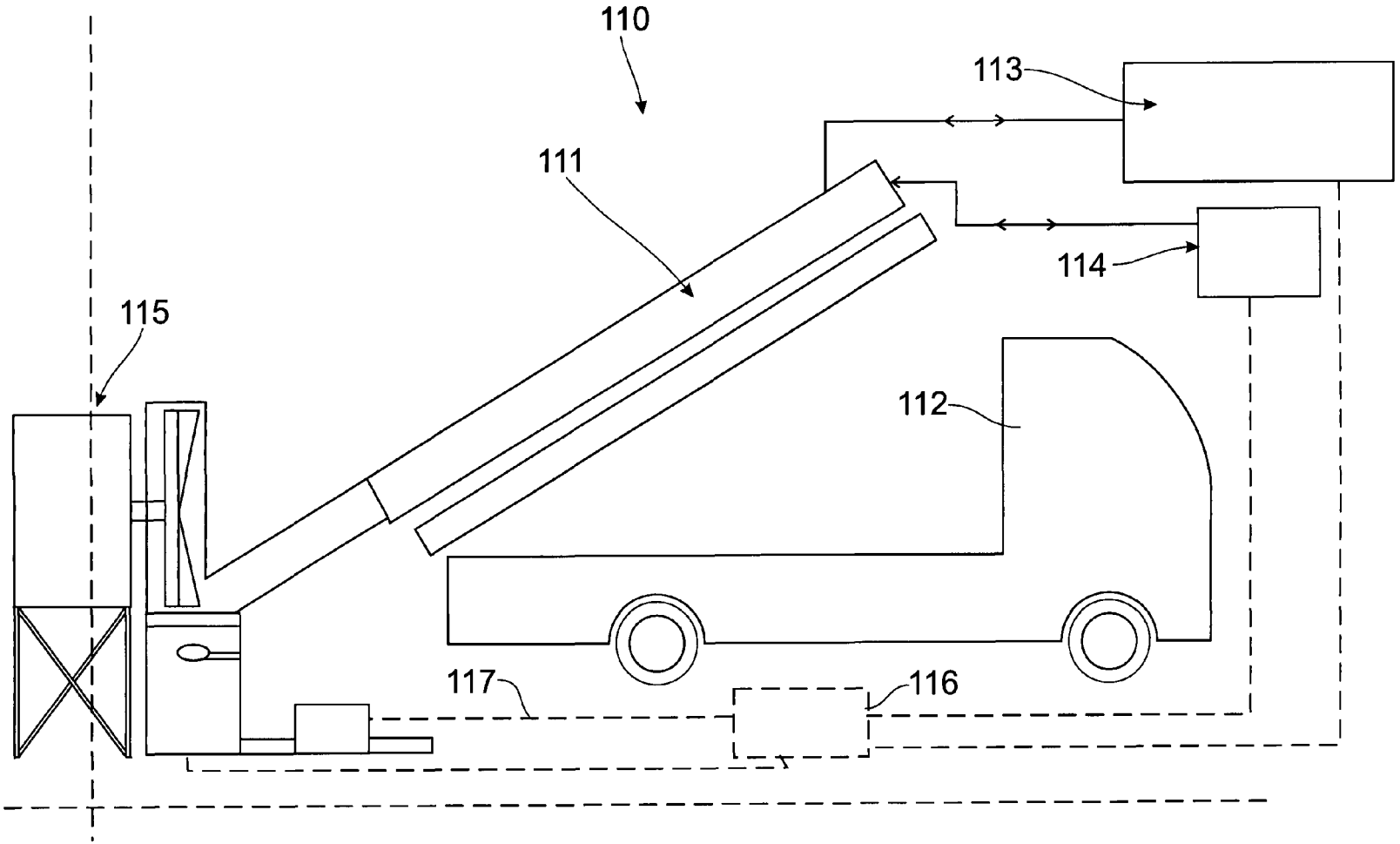
FIG. 11 is a schematic sketch of a sixth embodiment of a system for producing snow, which is particularly suitable for a ski-field.
Figure 12:
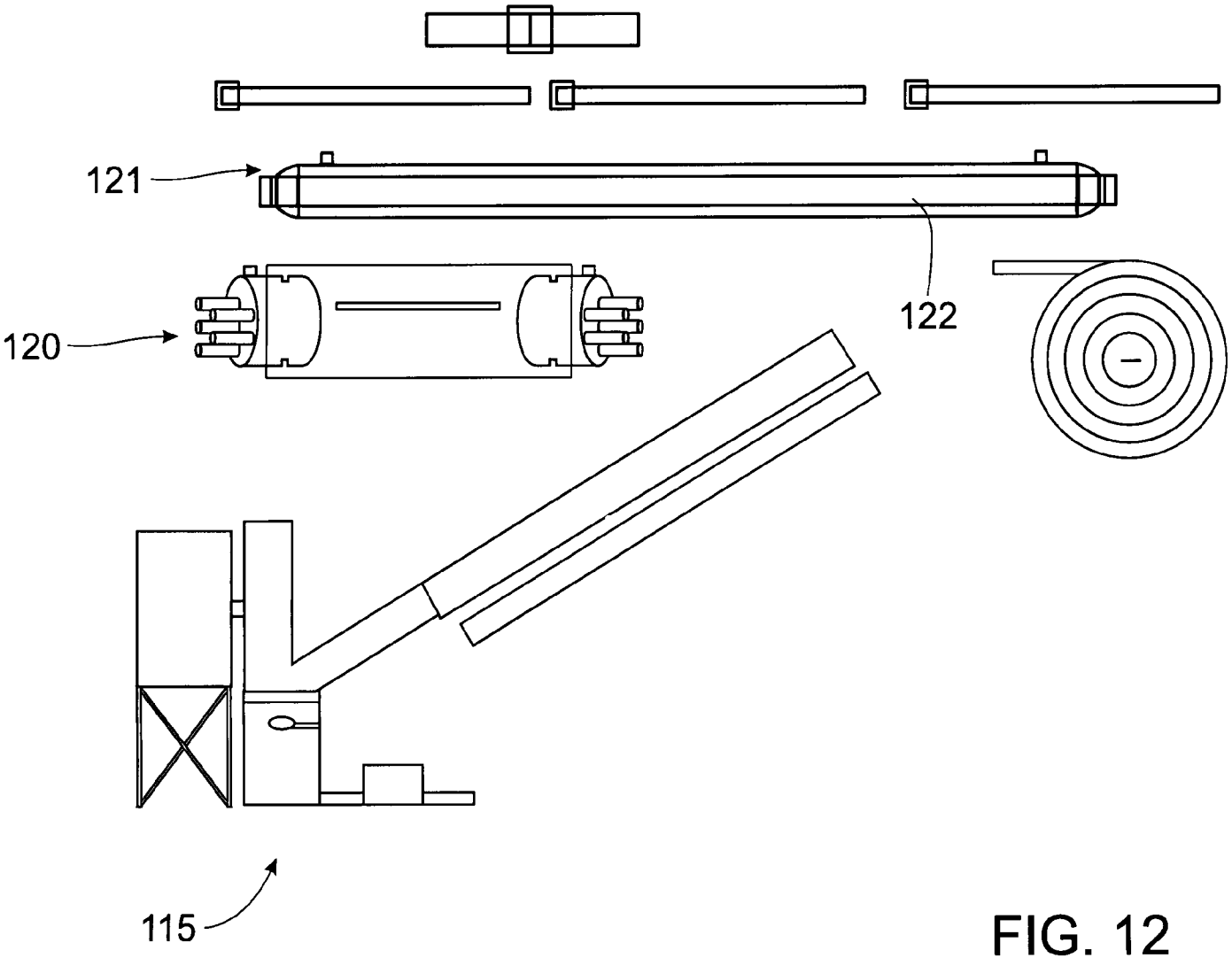
FIG. 12 is a schematic sketch of the components for the ice-making and snow-making machines of the system of FIG. 11.

FIGS. 11 and 12 illustrate a potentially transportable system 110 for producing snow, e.g., which may travel between entertainment locations or to different locations on ski fields.

The ice maker 111 for producing the ice may be mounted on a truck 112 and be operably connected to a brine chiller 113 and a steam generator 114, which may be mounted on trailers or skids for transportation from site to site. The snow-making machine 115 may be mounted on a further vehicle or on skids for transport; and the operation of the whole system may be computer-controlled via a PLC 116. In this arrangement, the only fixed equipment required on the site is a water supply 117.

As illustrated in FIG. 12, the ice maker 111 may comprise a tubular ice making machine 120, as hereinbefore described; or lengths of freezing pipe 121 which may be laid along a hillside and connected together or laid adjacent each other in a bank of the freezing pipes 121.

In this arrangement, the ambient temperature may be used to freeze the water, or to assist the freezing of the water by the brine chiller 113; and hot gas or steam may be pumped through the jackets 122 around the water freezing pipes 121 to enable the ice tubes to advance towards the snow-making machine 115.

The operation of the snow-making machine, and the innovation in the invention, resides, inter alia, in the discovery of the speed and the construction of the blades that impact the ice to produce the snow which can be used for a variety of applications.

The following chart shows the optimal radius of the blades from the centre of the impeller; and the required rotational speed of the impeller shaft, to generate the desired impact forces to produce and deliver the snow.

IMPELLER CHART INFORMATION

| A Speed Required km/hr | B Speed Required mts/min | C Radius of Blade metres | D Circumference of Impeller metres | E RPM Needed for Supply |
|---|---|---|---|---|
| 200 | 3333 | 0.01 | 0.06 | 53030 |
| 200 | 3333 | 0.02 | 0.13 | 26515 |
| 200 | 3333 | 0.05 | 0.31 | 10606 |
| 200 | 3333 | 0.1 | 0.63 | 5303 |
| 200 | 3333 | 0.2 | 1.26 | 2652 |
| 200 | 3333 | 0.5 | 3.14 | 1061 |
| 200 | 3333 | 1 | 6.29 | 530 |

The chart above shows the speed required at the tips of the blades to ensure that the ice is turned into a high quality snow product that is capable of being thrown over 20 m (60 feet) away from the snow making machine.

From the chart, it can be seen that a blade with a length of 50 cm travelling at a speed of 1061 rpm generates the same impact forces as a blade with a length of 20 cm in length, but travelling at a speed of 26,515 rpm.

It has been further found that when a blade travels at this speed, that the capacity of ice that can be fed into such a turning impeller can be as high as 5 KGs per second, for a 4-blade impeller that is connected to an electric motor with a capacity of at least 30 kW. This will provide for a total production of up to 432,000 Kg of ice per day. This would amount to 1080 $m^3$ of fresh snow production in a 24-hour period.

This innovation provides for a number of different forms of snow-making machinery that can be created and utilized using the present invention. For example, a one-impeller machine with four @20 cm (8 inch) long blades could be connected to a standard electric- or hydraulic-motor to generate a high daily snow-making capacity, while only requiring a very compact machine. By using a plurality of similar-sized impellers, it can be seen that the capacity of such a small unit can easily be multiplied (e.g. by 2 to 10 times) if multiple impellers are added to the system. In this way, a snow-making machine could be created where the snow-making machine could have a capacity of 10,000 $m^3$ of snow per day or more.

This high snow-masking capacity is a very important factor for ski-field operators, as the time taken to supervise the production and spreading of snow can be greatly reduced, so that there are savings in both labour and in energy input requirements, as the snow can be produced and distributed when energy prices are at their cheapest during the day.

Also, because of the speed created at the tip ends of the blades, the snow can be thrown in excess of 20 m from the snow-making machine. It would be possible to utilize such a machine to throw water particles into the air at sub-freezing temperatures to also make snow.

The system is based on the efficient freezing of water and in doing so has an ice making component as part of the equipment that will be described hereafter.

However unlike standard ice- or snow-making machine technology, the snow making machine described in this invention can in part be made of plastic tubing or similar materials which can be snap frozen by low air temperatures, low temperature coolants, cryogenic materials or even in a cold room environment operating at below freezing temperatures.

The ice-making technology is relatively simple and based on existing technologies; however, unlike standard ice making machines, the present invention can use 25-300 mm (1-12 inch) diameter (preferably 100 mm/4 inch) plastic or metal tubing for the water-freezing tubes of the ice-making machine of the system. The before-mentioned freezing tubes are filled with water and the water inside the tube is frozen in whole or in part when the outside of the tube comes in contact with cold ambient air, a cryogenic material, a low temperature coolant solution or a refrigerant.

The ice-making machine can also be used in a below freezing cold room.

After the ice tubes are frozen they can be removed by defrosting or mechanical or manual means and transported automatically or manually to the snow-making machine of the system, to produce high quality snow for skiing or snow play.

After the ice tubes have been made and discharged, the freezing tubes are again filled with water, so that the ice-making process can be repeated.

The ice can be made in the plastic or metal freezing tubes to freeze the water there-in by contact of the freezing tubes with cold air, with a cryogenic material, with a refrigerant connected to a refrigeration unit, immersion in cold brine/coolant, or sprayed with a below-freezing coolant solution.

The snow-making machine may have a combination snow-blower and snow-maker which is positioned directly below the ice inlet to the machine so that all the ice can be converted into snow and quickly blown from the machine e.g. onto a ski slope, into a storage bin, or to a location where the snow is required for use.

It has been found that when ice fragments, cubes, tubes or pieces come in contact with the impeller arm(s) and/or blade(s) travelling at a speed between 150 to 300 Km/h (93-187 MPH), the ice will be "pounded" into fine snow fragments i.e. snow "crystals" or "flakes" that can blown a distance of up to 20 to 50 meters (60 to 150 feet) from the snow-making machine.

It has also been found that when the snow-making machine is connected directly below the ice-making the machine, that a capacity of up to 1000 tonnes (tons) of ice can be converted into snow over a 24 hour period without difficulty.

It has been further found that the snow-making machine of a system capable of making 3000 $m^3$ of snow per day from 1000 tonnes (tons) of ice can be designed to occupy little space, can be simple to manufacture, and inexpensive to build and operate.

At present many ski resorts are concerned about the effects of global warming, which makes existing technologies that rely on cold air temperatures to make snow difficult to operate or justify the capital expenditure on when the ambient air temperatures are becoming warmer and the use of such expensive equipment more difficult to justify as an investment.

The present invention overcomes this problem by providing a system that can make snow 24 hours a day/365 days of the year. Unlike prior art freezing snow- or ice-making applications used at ski resorts, the present invention can utilize the cold ambient temperatures when they are available, to make inexpensive snow. However, when the ambient conditions are above freezing, or when the location of use is in warmer climes, then the present system can be used with artificial cooling means to create high-quality man-made snow.

Not only is it possible to use the cold ambient air conditions to make the snow at a ski resort, it is also possible to store the ice that is made using the present system so that it can be used at a later time, or when the prevailing weather conditions are more suitable for the snow to be made and distributed to the ski area.

Also, unlike other systems, the snow-making machine of the present invention is less expensive and more efficient to operate, as all the water that enters the system is converted to snow and can be blown or transported to the area where the snow is required.

A further advantage of the invention is that snow-making machine can be provided as a rental unit, whereby it is only used or needed at times when there are limited natural snow falls, or the prevailing weather conditions do not allow for a ski resort operator to use his existing assets to make snow.

In this case, the snow-making machine is connected to a source of below-freezing air, refrigerants, antifreeze, or cryogenic material to make the snow effectively and efficiently.

While the description has specifically referred to the application of the present invention to produce snow for recreational purposes, it will be clear to those skilled in the art that the present invention could be utilized in many other areas where large quantities of snow are required for cooling.

This skilled addressee will appreciate the present invention can provide a system, including a snow-making machine, capable of producing high-quality snow efficiently and in large quantities. The system can be used in above- and below-freezing environments to make man-made snow, while at the same time, generating heat that can be used for air-conditioning.

Various changes and modifications may be made to the embodiments described and illustrated without departing from the present invention.

What is claimed is:

1. A method for manufacturing snow, including:

driving at least one impeller, having at least one blade, rotatably mounted within a snow-making chamber of a snow-making apparatus;

feeding ice from a supply to at least one inlet of the snow-making chamber; wherein the snow-making chamber is separated into a plurality of sub-chambers by respective dividing walls between each pair of sub-chambers; wherein each sub-chamber has a respective inlet and outlet; and each sub-chamber has a respective impeller containing a plurality of the blades, impacting the ice with the at least one blade to convert the ice to snow; and discharging the snow from at least one outlet from the snow-making chamber.

2. A method as claimed in claim 1, wherein the ice is fed to the at least one sub-chamber inlet in block or tube form.

3. A method as claimed in claim 1, wherein at least one blade of the impeller impacts the ice with a tangential) velocity component in the range 150-300 Km/h (93-187 MPH).

4. A method as claimed in claim 3, wherein at least one impeller is driven at 100%≦5% of a preselected rotational speed.

5. A method as claimed in claim 1, wherein air is introduced in the at least one inlet with the ice; and an airflow within the snow-making chamber is generated by the, or each, blade, to assist the discharge of the snow from the at least one outlet.

6. The method of claim 1, wherein at least one blade of the impeller impacts the ice with a tangential velocity component of 180-260 Km/h (112-161 MPH).

7. The method of claim 1, wherein at least one blade of the impeller impacts the ice with a tangential velocity component of 200-220 Km/h (124-137 MPH).

* * * * *